US009016848B2

(12) United States Patent
Shimizu

(10) Patent No.: US 9,016,848 B2
(45) **Date of Patent: *Apr. 28, 2015**

(54) RECORDING APPARATUS AND CONTROLLER USED IN RECORDING APPARATUS

(75) Inventor: Seiji Shimizu, Ogaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 62 days.

This patent is subject to a terminal disclaimer.

(21) Appl. No.: 13/324,919

(22) Filed: Dec. 13, 2011

(65) Prior Publication Data

US 2012/0154485 A1 Jun. 21, 2012

(30) Foreign Application Priority Data

Dec. 15, 2010 (JP) ..... 2010-278870

(51) Int. Cl.
*B41J 2/165* (2006.01)
*B41J 11/00* (2006.01)

(52) U.S. Cl.
CPC ..... *B41J 2/16538* (2013.01); *B41J 2/16585* (2013.01); *B41J 11/002* (2013.01)

(58) Field of Classification Search
None
See application file for complete search history.

(56) References Cited

U.S. PATENT DOCUMENTS

2003/0184631 A1* 10/2003 Suzuki et al. ..... 347/102
2005/0190248 A1 9/2005 Konno et al.
2007/0146415 A1* 6/2007 Jung et al. ..... 347/33
2008/0074484 A1* 3/2008 Sugahara ..... 347/102
2008/0204536 A1* 8/2008 Suzuki ..... 347/102
2008/0278537 A1 11/2008 Watanabe
2011/0242204 A1* 10/2011 Shinoda ..... 347/29

FOREIGN PATENT DOCUMENTS

JP H09-085959 A 3/1997
JP H11-291511 A 10/1999
JP 2003-103793 A 4/2003
JP 2004-314478 A 11/2004
JP 2005-280346 A 10/2005
JP 2006-116907 A 5/2006
JP 2006-205517 A 8/2006
JP 2007-253391 A 10/2007
JP 2007-253592 A 10/2007

OTHER PUBLICATIONS

Japan Patent Office, Notice of Reasons for Rejection for Japanese Patent Application No. 2010-278870 (counterpart to above-captioned patent application), mailed Nov. 19, 2013.

* cited by examiner

*Primary Examiner* — Alejandro Valencia
(74) *Attorney, Agent, or Firm* — Baker Botts L.L.P.

(57) ABSTRACT

A recording apparatus comprises a conveyor, a head including an ejection surface, a UV irradiator positioned downstream of the head in a conveyance direction, a wiper, a first shading member, and first and second controllers. The first shading member is movable in a cross direction crossing the ejection surface, and shades an opposed space being opposed to the ejection surface from ultraviolet light applied by the UV irradiator in a state where the first shading member is taking a protruding position. The first controller controls the first shading member to take the protruding position. The second controller controls the wiper to move relatively to the ejection surface while causing the wiper to contact the ejection surface in a state where the wiper is positioned in the opposed space and the first shading member is taking the protruding position, when the wiping is performed.

13 Claims, 12 Drawing Sheets

FIG.7B <BEFORE AND AFTER WIPING> <DURING WIPING>

FIG.7C <BEFORE AND AFTER WIPING> <DURING WIPING>

RECORDING APPARATUS AND CONTROLLER USED IN RECORDING APPARATUS

CROSS REFERENCE TO RELATED APPLICATION

This application claims priority from Japanese Patent Application No. 2010-278870, which was filed on Dec. 15, 2010, the disclosure of which is herein incorporated by reference in its entirety.

BACKGROUND OF THE INVENTION

1. Field of the Invention

The present invention relates to: a recording apparatus which conducts recording using a liquid curable by irradiation of ultraviolet light; and a controller used in the recording apparatus.

2. Description of Related Art

There has been known a recording apparatus which conducts recording using a liquid curable by irradiation of ultraviolet (UV) light, such as UV curable ink. The recording apparatus may have: a head which ejects, to a recording medium, the liquid curable by irradiation of ultraviolet light; and a UV irradiator such as a light source which applies ultraviolet light to the recording medium, for example. The UV irradiator is positioned downstream of the head in a conveyance direction of the recording medium.

Meanwhile, as maintenance for the head, there has been known wiping, an operation in which foreign matter such as ink or paper dust attached to an ejection surface of the head is wiped out using a wiper, which is constituted of an elastic member and the like and is moved relatively to the ejection surface while contacting the ejection surface.

SUMMARY OF THE INVENTION

However, there may arise a problem that liquid attached to the wiper is cured, by ultraviolet light applied from the UV irradiator, thereby causing a decrease in wiping performance.

One idea to deal with this problem is to turn off the UV irradiator for a while i.e., to stop irradiation of ultraviolet light, in order to prevent ultraviolet light from being applied to the wiper. However, if the UV irradiator is turned off during the wiping and then is turned on for resuming a recording operation, some period of time is needed, before an intensity of ultraviolet light is stabilized, and this causes a loss of time.

An object of the present invention is to provide a recording apparatus and a controller each of which makes it possible to prevent liquid attached to the wiper from being cured, without turning off the UV irradiator during the wiping.

According to a first aspect of the present invention, provided is a recording apparatus comprising a conveyor, a head, a UV irradiator, a wiper, a first shading member, a first controller, and a second controller. The conveyor conveys a recording medium in a conveyance direction. The head includes an ejection surface at which a plurality of ejection openings are formed from which openings liquid curable by irradiation of ultraviolet light is ejected to the recording medium. The UV irradiator is positioned downstream of the head in the conveyance direction and applies ultraviolet light to the recording medium. The wiper is movable relatively to the ejection surface while contacting the ejection surface and performs wiping in which foreign matter attached to the ejection surface is wiped out. The first shading member is movable in a cross direction crossing the ejection surface, and shades an opposed space being opposed to the ejection surface from ultraviolet light applied by the UV irradiator in a state where the first shading member is taking a protruding position, in the protruding position the first shading member protruding from the ejection surface in the cross direction. The first controller controls the first shading member to take the protruding position. The second controller controls the wiper to move relatively to the ejection surface while causing the wiper to contact the ejection surface in a state where the wiper is positioned in the opposed space and the first shading member is taking the protruding position, when the wiping is performed.

According to a second aspect of the present invention, provided is a controller which is used in a recording apparatus. The recording apparatus includes: a conveyor which conveys a recording medium in a conveyance direction; a head including an ejection surface at which a plurality of ejection openings are formed from which openings liquid curable by irradiation of ultraviolet light is ejected, to the recording medium; a UV irradiator which is positioned downstream of the head in the conveyance direction and applies ultraviolet light to the recording medium; a wiper which is movable relatively to the ejection surface while contacting the ejection surface and performs wiping in which foreign matter attached to the ejection surface is wiped out; and a first shading member which is movable in a cross direction crossing the ejection surface, and shades an opposed space being opposed to the ejection surface from ultraviolet light applied by the UV irradiator in a state where the first shading member is taking a protruding position, in the protruding position the first shading member protruding from the ejection surface in the cross direction. The controller comprises: a first controller which controls the first shading member to take the protruding position; and a second controller which controls the wiper to move relatively to the ejection surface while causing the wiper to contact the ejection surface in a state where the wiper is positioned in the opposed space and the first shading member is taking the protruding position, when the wiping is performed.

BRIEF DESCRIPTION OF THE DRAWINGS

Other and farther objects, features and advantages of the invention will appear more fully from the following description taken in connection with the accompanying drawings in which:

FIG. 7B is a partial sectional view of the wiper unit, illustrating: a state of the wiper unit before and after the wiping; and a state of the wiper unit during the wiping.

FIG. 7C is a sectional view of a wiper, illustrating: a positional relation between the wiper and a through hole before and after the wiping; and the positional relation therebetween during the wiping.

DESCRIPTION OF THE PREFERRED EMBODIMENTS

The following describes preferred embodiments of the present invention, with reference to the drawings.

Figure 1:
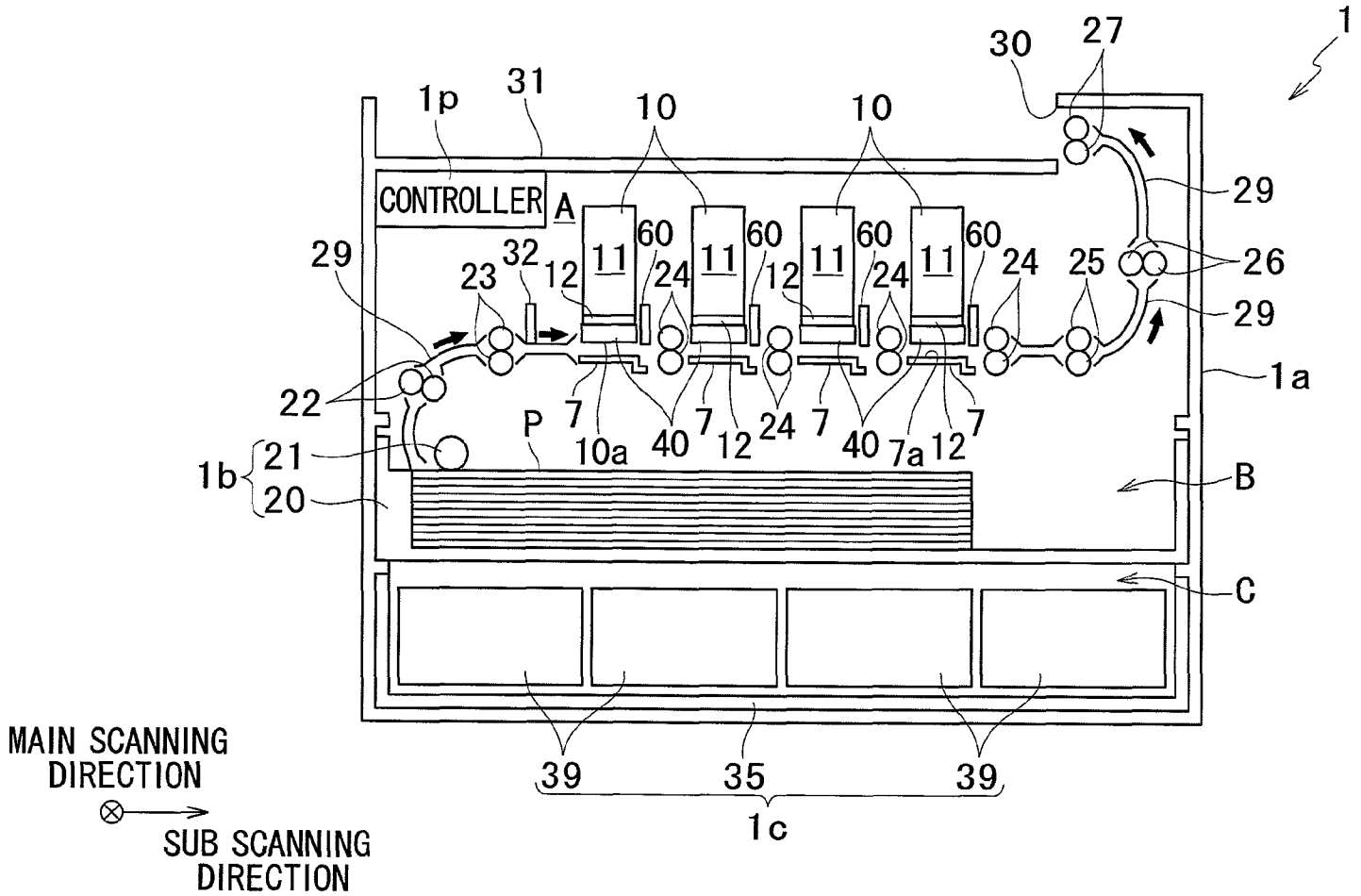
FIG. 1 is a schematic side view illustrating an internal structure of an ink-jet printer which is a first embodiment of a recording apparatus of the present invention.

First, with reference to FIG. 1, explanation will be given on an overall structure of an ink-jet printer 1 which is a first embodiment of a recording apparatus of the present invention.

The printer 1 has a housing 1*a* of a rectangular parallelepiped shape. A discharged paper receiver 31 is provided on a top panel of the housing 1*a*. An internal space of the housing 1*a* is capable of being divided into spaces A, B, and C, from the top to the bottom. In the space B, a paper feed unit 1*b* is disposed. A sheet conveyance path from the paper feed unit 1*b* to the discharged paper receiver 31 is formed in the spaces A and B.

In the space A, there are disposed: a sheet sensor 32; four heads 10; four UV irradiators 60; a conveyor; guides 29 which guide a sheet P; a controller 1*p*; and the like. The conveyor is constituted by: four platens 7 disposed so as to be opposed to the four heads 10 respectively; and pairs of feed rollers 22 to 27 disposed along the sheet conveyance path, and the conveyor conveys a sheet P in a conveyance direction indicated with bold, arrows in FIG. 1.

Each head 10 is a line-type ink-jet head which extends in a main scanning direction and has a substantially rectangular parallelepiped shape. At the time of recording, magenta, cyan, yellow, and black UV curable inks which are curable by irradiation of ultraviolet light are respectively ejected from under surfaces, i.e., ejection surfaces 10*a*, of the four heads 10. In the vicinity of a lower end of each head 10, there is provided an annular cap 40 which surrounds an outer circumference of its ejection surface 10*a*. Further, a wiper unit 70 and a shading plate 80 (see FIGS. 6A to 6C) are disposed for each head 10. Detailed description will be provided later on a structure, operation, function, and the like, of the caps 40, wiper units 70, and shading plates 80.

The UV irradiators 60 are respectively provided for the heads 10, and each of the UV irradiators 60 is disposed downstream of the corresponding head 10 in a direction along which a sheet P is conveyed by the conveyor. This direction is indicated with the bold arrows in FIG. 1, and is hereinafter simply referred, to as a "conveyance direction". Each UV irradiator 60 extends in the main scanning direction and has an outline of substantially rectangular parallelepiped shape, similarly to each head 10. A plurality of light sources 61, such as halogen lamps, (see FIGS. 6A and 6C) arranged, in the main scanning direction are provided on an under surface of each UV irradiator 60. At the time of recording, ultraviolet light is applied from the light sources 61 of each UV irradiator 60, and thereby UV curable ink attached onto a sheet P is cured and fixed.

The heads 10 and the UV irradiators 60 are aligned in a sub scanning direction at predetermined intervals, and are supported by the housing 1*a* via a not-shown frame.

The paper feed unit 1*b* has a paper feed tray 20 and a paper feed roller 21. Of these, the paper feed tray 20 is removable from the housing 1*a*. The paper feed tray 20 is a box having an open top, and is capable of containing different sizes of sheets P. The paper feed roller 21 forwards an uppermost sheet P of the sheets P contained in the paper feed tray 20.

The controller 1*p* controls an operation of each unit of the printer 1, and thereby controlling an overall operation of the printer 1. Based on image data supplied from an external device such as a PC connected to the printer 1, the controller 1*p* controls the following operations of: preparation related to recording; feed, conveyance, and discharge of a sheet P; ejection of ink and irradiation of ultraviolet light in synchronization with the conveyance of the sheet P; and the like, so that an image is formed on the sheet P. Further, the controller 1*p* controls a later-described maintenance operation related to recovery and maintenance of ejection performance of the heads 10.

Based on a recording command received from the external device, the controller 1*p* drives a paper feed motor 125 (see FIG. 8) for the paper feed roller 21, feed motors 127 (see FIG. 8) for the respective pairs of feed rollers 22 to 27, and the like. A sheet P forwarded from the paper feed tray 20 is sent to a recording position between the ejection surfaces 10*a* and support surfaces 7*a* of the respective platens 7, while being guided by the guides 29 and being gripped by the pairs of feed rollers 22 and 23 sequentially. When the sheet P passes immediately below the heads 10 in the sub scanning direction i.e., in the conveyance direction, the controller 1*p* performs a control operation so that the UV curable inks are sequentially ejected from the respective ejection surfaces 10*a* to a surface of the sheet P and then ultraviolet light is applied from the respective UV irradiators 60, with the result that a color image is formed on the sheet P. Ejection of the UV curable inks and irradiation of ultraviolet light are performed based, on a detection signal from the sheet sensor 32 which detects a leading end of the sheet P. During the recording, the sheet P is conveyed while being supported by the support surfaces 7*a* of the platens 7 being opposed to the respective ejection surfaces 10*a*, and while being gripped by the pairs of feed rollers 24 sequentially, which are respectively disposed downstream of the corresponding heads 10 in the conveyance direction. Then, the sheet P having an image formed thereon is conveyed upward while being guided by the guides 29 and while being gripped, by the pairs of feed rollers 25, 26, and 27, and then the sheet P is discharged from an opening 30 formed at an upper portion of the housing 1*a* to the discharged paper receiver 31.

Here, the sub scanning direction is a direction parallel to the conveyance direction, and the main scanning direction is a direction parallel to a horizontal surface and orthogonal to the sub scanning direction.

In the space C, a cartridge unit 1*c* is disposed removably from the housing 1*a*. The cartridge unit 1*c* has a tray 35, and four cartridges 39 placed side-by-side with one another in the tray 35. The cartridges 39 communicate with the heads 10 via not-shown tubes, respectively, and each of the cartridges 39 reserves UV curable ink of a color corresponding to the associated head 10. The ink reserved in each cartridge 39 is supplied to the associated head 10, where necessary.

Next, a structure of each head 10 will be described in more detail, with reference to FIGS. 2 to 5. Note that, in FIG. 3, pressure chambers 16 and apertures 15, which are located below the actuator units 17 and should be depicted with dotted lines, are depicted with solid lines.

Figure 5:
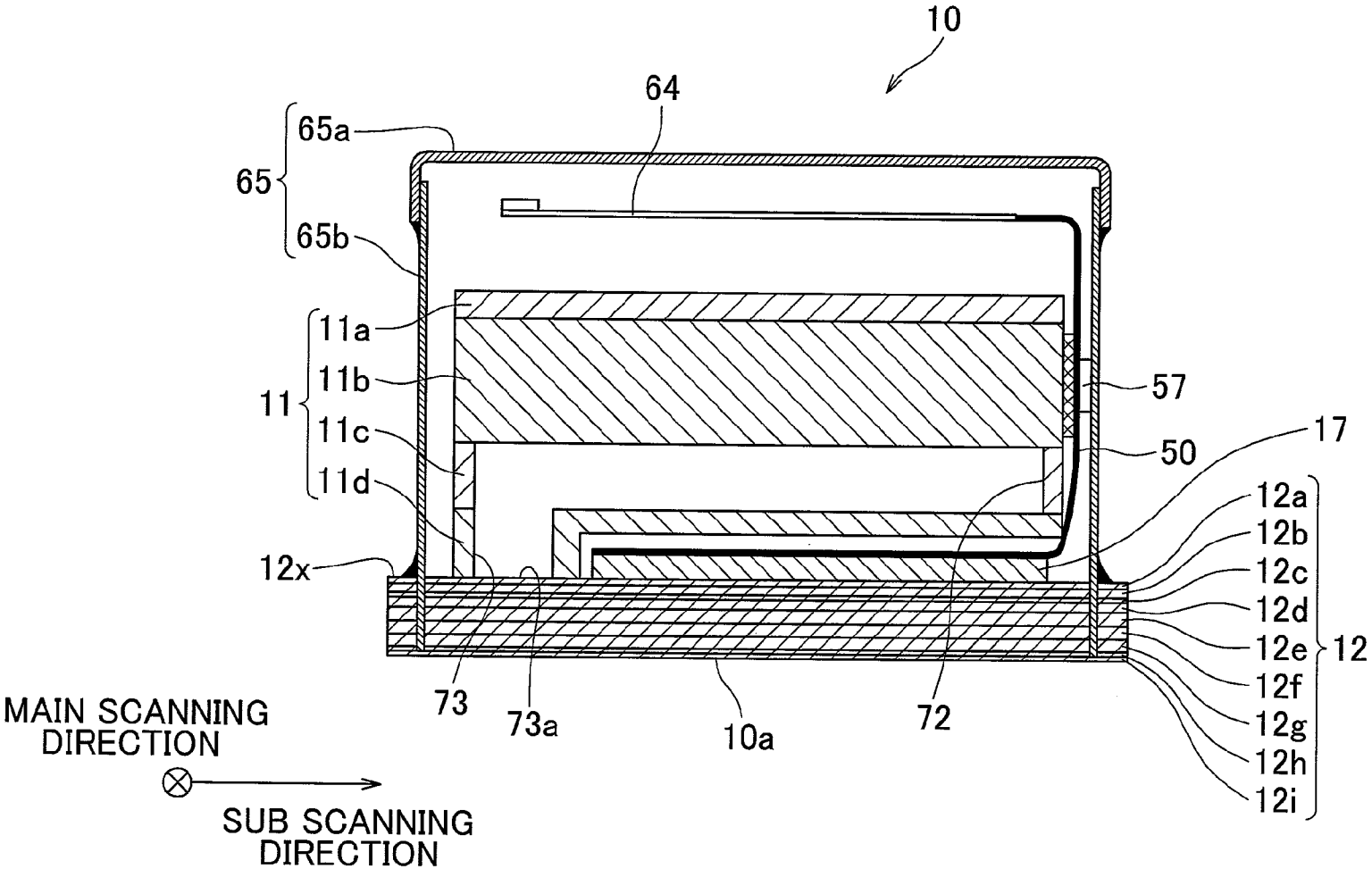
FIG. 5 is a vertical sectional view of the ink-jet head.

As shown in FIG. 5, each head 10 is a member constructed by stacking a passage unit 12, the actuator units 17, a reservoir unit 11, and a substrate 64. Of these, the actuator units 17, the reservoir unit 11, and the substrate 64 are housed in a space created by an upper surface 12*x* of the passage unit 12 and a cover 65. In this space, FPCs (flexible printed circuits) 50 electrically connect the respective actuator units 17 to the substrate 64. Each FPC 50 has a driver IC 57 mounted on a portion between both ends of the FPC 50.

As shown in FIG. 5, the cover 65 includes a top cover 65*a* and a side cover 65*b*. The cover 65 is a box having an open bottom, and is fixed, to the upper surface 12*x* of the passage unit 12. The side cover 65*b* is made of aluminum plates, and also functions as a heatsink. The driver IC 57 abuts an internal surface of the side cover 65*b*, and is thermally coupled with the cover 65*b*.

The reservoir unit 11 is a stack constituted of four metal plates 11*a* to 11*d* attached to one another, in each of which plates a through hole and/or a recess is/are formed. Protrusions are formed on a surface of the plate 11*d*. An ink passage including a reservoir 72 is formed inside the reservoir unit 11. One end of the ink passage is connected to the corresponding cartridge 39 via the tube or the like, while the other end of the passage is connected to openings provided at an under surface of the reservoir unit 11. In the plate 11*d*, there are formed ink outflow passages 73 communicating with the reservoir 72. One end of each of the ink outflow passages 73 is connected to an opening provided at an end surface of the corresponding protrusion of the plate 11*d*, which surface is bonded to the upper surface 12*x*.

Figure 2:
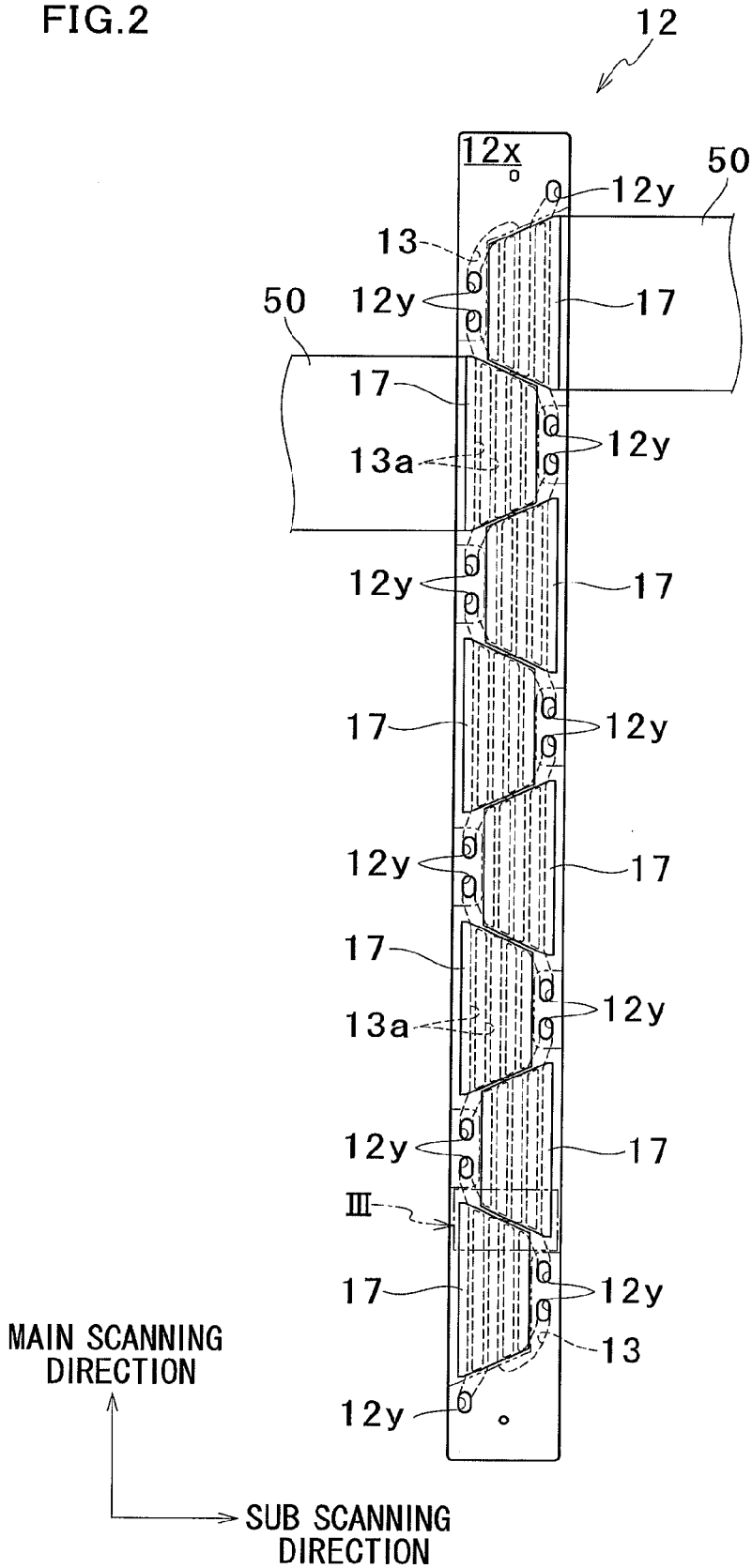
FIG. 2 is a plan view illustrating a passage unit and actuator units of an ink-jet head included in the printer of FIG. 1.
Figure 3:
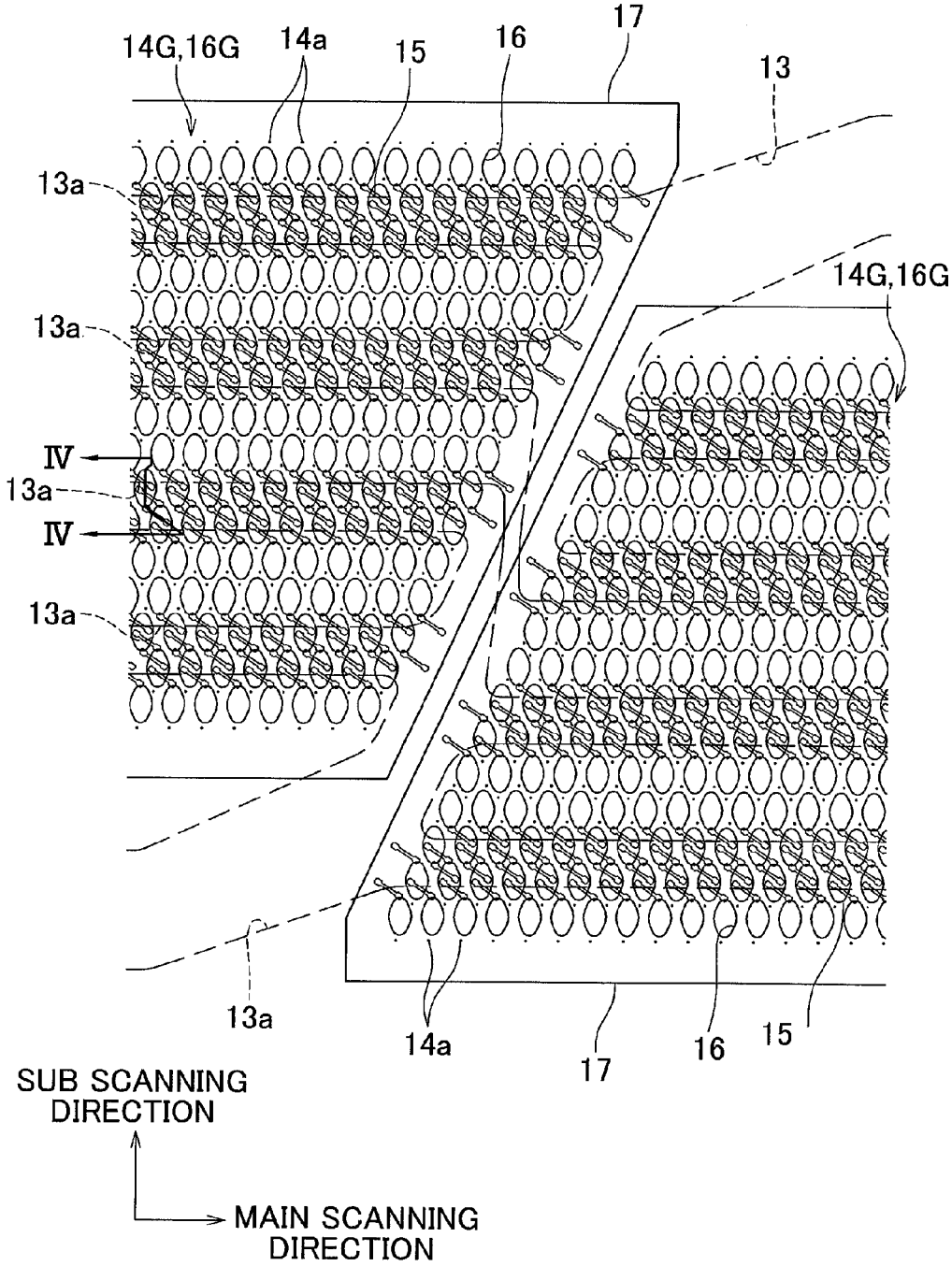
FIG. 3 is an enlarged view illustrating an area III encircled by an alternate long and short dash line of FIG. 2.
Figure 4:
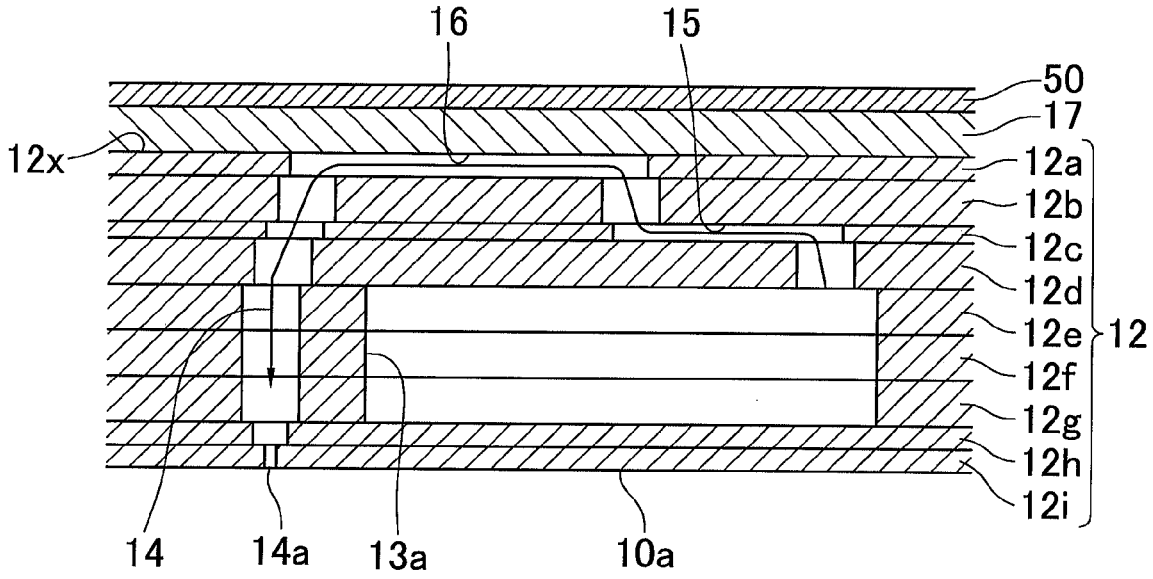
FIG. 4 is a partial sectional view taken along line IV-IV of FIG. 3.

The passage unit 12 is a stack constituted of nine quadrangular metal plates 12*a*, 12*b*, 12*c*, 12*d*, 12*e*, 12*f*, 12*g*, 12*h*, and 12*i* (see FIG. 4) of a substantially same size attached to one another. As shown in FIG. 2, openings 12*y* respectively opposed to openings 73*a* of the ink outflow passages 73 are formed, at the upper surface 12*x* of the passage unit 12. Inside the passage unit 12, there are formed ink passages extending from the respective openings 12*y* to ejection openings 14*a*. As shown in FIGS. 2, 3, and 4, each of the ink passages includes: a manifold channel 13 having the opening 12*y* at its one end; sub-manifold channels 13*a* which are branches of the manifold channel 13; and individual passages 14 respectively extending from outlets of the sub-manifold channels 13*a* to the ejection openings 14*a* via the pressure chambers 16.

As shown in FIGS. 2 and 3, the manifold, channel 13 and the sub-manifold channels 13*a* are in common among the plurality of ejection openings 14*a*. The individual passages 14 are respectively formed for the ejection openings 14*a*, and each individual passage 14 includes: an aperture 15 acting as a throttle for adjusting passage resistance; and a pressure chamber 16 which opens onto the upper surface 12*x*, as shown in FIG. 4. As shown in FIG. 3, the pressure chambers 16, each of which has a substantially rhombus shape, are arranged, in a matrix. A group of pressure chambers 16 occupies a substantially trapezoidal area in a plan view, and in total, eight pressure chamber groups 16G are formed. In the same way as the pressure chambers 16, the ejection openings 14*a* which open onto the ejection surface 10*a* are also arranged in a matrix, and constitute eight ejection opening groups 14G each of which groups occupies a substantially trapezoidal area in a plan view. The ejection opening groups 14G and the pressure chamber groups 16G are arranged on the ejection surface 10*a* and the upper surface 12*x* respectively, in a staggered fashion in two rows along the main scanning direction.

As shown in FIG. 2, each of the actuator units 17 has a trapezoidal planar shape and is disposed on a corresponding one of the trapezoidal areas of the pressure chamber groups 16G. A lower base of the trapezoidal shape of every actuator unit 17 is close to either of both ends, in the sub scanning direction, of the passage unit 12. The actuator units 17 are disposed in respective gaps created by the reservoir unit 11 and the passage unit 12, so as to avoid the protrusions provided at the under surface of the reservoir unit 11. Although not shown in the drawings, each actuator unit 17 is a stack constituted of a diaphragm, a common electrode, a piezoelectric layer, and individual electrodes, which are stacked on one another in this order. Among the above-mentioned members, the piezoelectric layer, the diaphragm, and the common electrode have a trapezoidal shape of which size defines an outline of the actuator unit 17. The individual electrodes are disposed on an upper surface of the piezoelectric layer so as to be opposed to the corresponding pressure chambers 16 respectively, and have a substantially similar shape to that of the pressure chambers 16. The number of individual electrodes formed is the same as that of the pressure chambers 16 of a corresponding pressure chamber group 16G. The diaphragm is disposed between the common electrode and the passage unit 12. Each of the portions of the actuator unit 17 which are respectively opposed to the individual electrodes functions as a piezoelectric actuator independent from one another.

The FPCs 50 are respectively provided for the actuator units 17, and each of the FPCs 50 has wires associated with the electrodes of the corresponding actuator unit 17. These wires are respectively connected to output terminals of the corresponding driver IC 57. Under the control of the controller 1*p* (see FIG. 1), each FPC 50 transmits various drive signals adjusted in the substrate 64 to the corresponding driver IC 57, and transmits drive signals generated in the driver IC 57 to the corresponding actuator unit 17.

Next, with reference to FIGS. 6A to 6C, explanation will be given on: the structure, operation, function, and the like of the caps 40, wiper units 70, and shading plates 80; and the maintenance operation. Each cap 40 and each wiper unit 70 are used, for the maintenance operation of the corresponding head 10.

The maintenance operation includes: preliminary ejection such as purging or flushing; wiping; capping; and the like. Here, the purging is an operation in which ink is discharged from ail the ejection openings 14*a* (see FIG. 4) by driving a pump to apply a pressure to the ink in the heads 10. The flushing is an operation in which ink is ejected from all the ejection openings 14*a* by driving all the actuators of the heads 10 based, on flushing data different from the image data. The wiping is an operation in which foreign matter such as ink or paper dust on the ejection surfaces 10*a* is wiped out using wipers 71 (see FIG. 6B) after the preliminary ejection. The capping is an operation in which opposed spaces V1 being opposed to the respective ejection surfaces 10*a* are separated from an external space V2 by the caps 40. The preliminary ejection is performed, for example, on the following occasions: immediately after the printer 1 is powered on; when a jam of a sheet P occurs in the conveyance path; when no ink is ejected from the ejection openings 14*a* for a predetermined period of time or more; and the like. The capping is performed on an occasion other than the above. The preliminary ejection allows thickened ink around the ejection openings 14*a*, or dust or bubbles inside the heads 10 to be discharged, together with the ink, and allows meniscuses in the ejection openings 14*a* to be maintained in good conditions. The wiping allows foreign matter on the ejection surfaces 10*a* to be wiped out. The capping prevents drying around the ejection openings 14*a*. Thus, the maintenance operation realizes a recovery of ink ejection performance of the heads 10 or prevents deterioration in the performance.

Each of the caps 40 is made of a lightproof elastic material such as rubber, and has an annular shape which surrounds an entire outer circumference of the corresponding ejection surface 10*a*, in a plan view, A sponge 40S capable of retaining ink is provided on an inner surface of the each cap 40 along its entire circumference. The sponge 40S is interposed between the inner surface of the cap 40 and side surfaces of the corresponding passage unit 12. The sponge 40S extends, inside the cap 40, from an upper end of the cap 40 to a position in the vicinity of a lower end 40*a*.

Figure 6A:
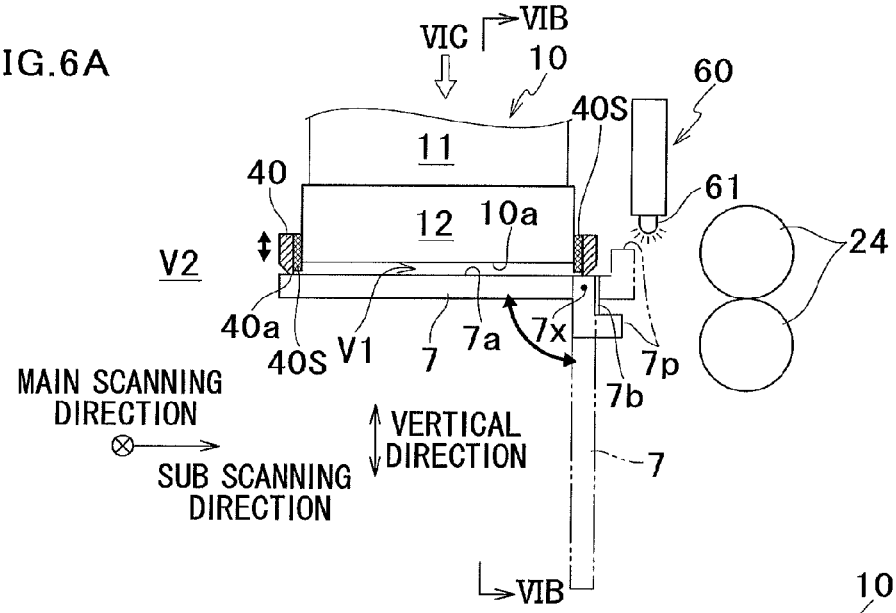
FIG. 6A is a partial sectional side view illustrating: one ink-jet head; and a UV irradiator, a wiper unit, and the like which correspond to this head.
Figure 6B:
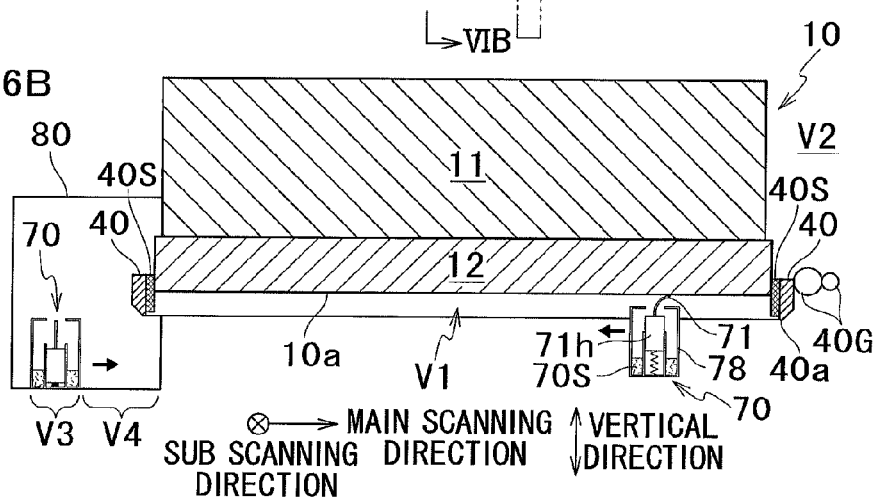
FIG. 6B is a partial sectional view taken along line VIB-VIB of FIG. 6A.

Each cap 40 is movable upward and downward, by driving a corresponding gear 40G (see FIG. 6B). This movement allows each cap 40 to selectively take: a protruding position where its lower end 40*a* is located below the corresponding ejection surface 10*a*, that is, the lower end 40*a* protrudes downward from the ejection surface 10*a*, as shown in FIGS. 6A and 6B; and a withdrawal position where the lower end 40*a* is located above the ejection surface 10*a*. Further, the protruding position includes a first protruding position shown in FIG. 6A, and a second protruding position shown in FIG. 6B, in which position the lower end 40*a* protrudes further downward, compared to the first protruding position. Thus, each cap 40 is capable of selectively taking a total of three positions of: the withdrawal position; the first protruding position; and the second protruding position. During the recording operation, each cap 40 takes the withdrawal position. During the capping, each cap 40 takes the first protruding position (see FIG. 6A). At this time, each tapered lower end 40*a* contacts the corresponding support surface 7*a*, and thereby the corresponding opposed space V1 between the ejection surface 10*a* and the support surface 7*a* is separated from the external space V2. At the time of the wiping, each cap 40 takes the second protruding position (see FIG. 6B). This will be described later in detail.

As shown in FIG. 6A, each platen 7 has a flat portion and an L-shaped portion 7*p*, and has, at a connection between these portions, a pivot axis 7*x* extending in the main scanning direction. Each axis 7*x* is located downstream of the corresponding head 10 in the conveyance direction. Pivoting movement about the pivot axis 7*x* allows each platen 7 to selectively take: an opposed, position where its flat portion is held horizontally with respect to a vertical direction and is opposed, to the corresponding ejection surface 10*a* in the vertical direction, as depicted with solid lines in FIG. 6A; and a non-opposed position where the flat portion is not opposed to the ejection surface 10*a* but is hanged downward, as depicted with alternate long and two short dashes lines in FIG. 6A. Each platen 7 takes the non-opposed position at the time of the wiping, and takes the opposed position at times other than the wiping. The L-shaped portion 7*p* is of an L-shape when viewed from the main scanning direction, i.e., in a sectional view of the platen 7 taken along a plane extending in the sub scanning direction and the vertical direction. When each platen 7 is in the opposed position, its L-shaped portion 7*p* is positioned below its flat portion. A shading sheet 7*b* is disposed on an inner wall surface of each L-shaped portion.

As shown in FIG. 6B, each wiper unit 70 has: a wiper 71; a holder 71*h*; a sponge 70S capable of retaining ink; a wiper case 78 which houses these members; and the like. Each wiper unit 70 is movable together with its case 78, and is positioned at a standby space V3, which is situated outside the opposed space V1 and farther from a viewer than the corresponding head 10 in FIG. 1, at times other than the wiping. At the time of the wiping, the wiper unit 70 is moved from the standby space V3, and is passed through an intermediate space V4 situated between the standby space V3 and the opposed space V1, and then the wiper unit 70 is positioned in the opposed space V1.

Each wiper 71 is a plate-like member made of an elastic material such as rubber and extends in the sub scanning direction and the vertical direction. With respect to the sub scanning direction, a length (width) of each wiper 71 is slightly longer than a length (width) of the corresponding ejection surface 10*a*. A lower end of each wiper 71 is fixed to its holder 71*h*.

Figure 7A:
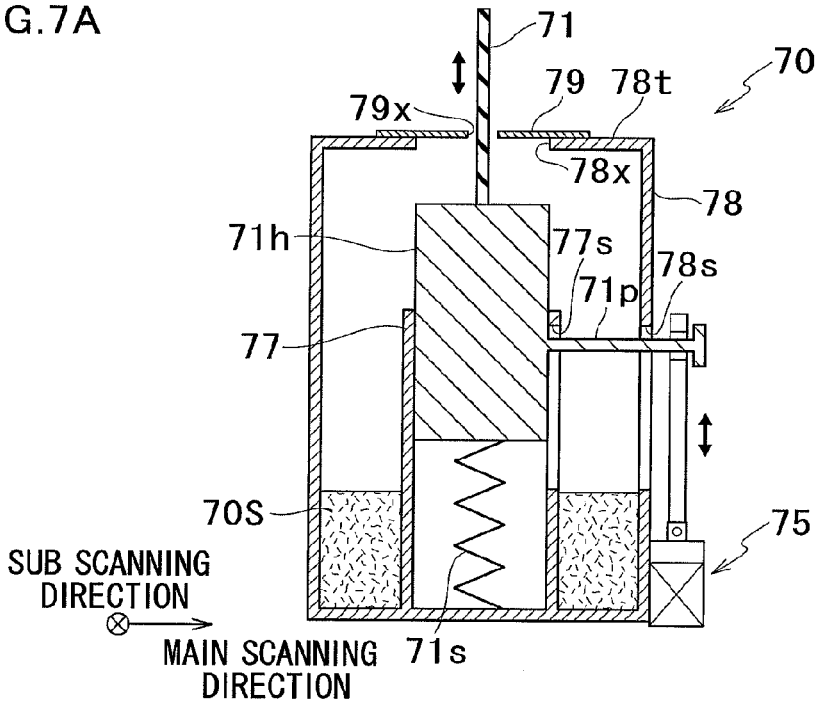
FIG. 7A is a sectional view of the wiper unit.
Figure 7A:
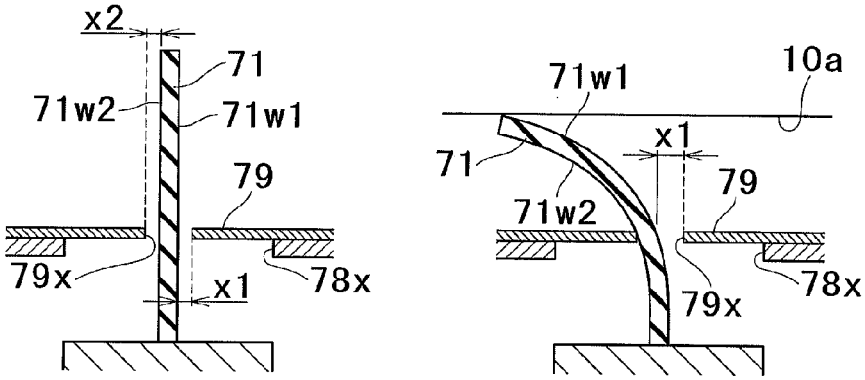
Figure 7A:
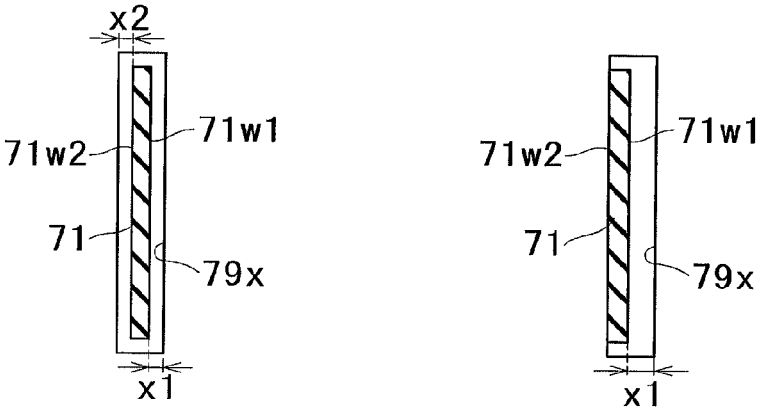

As shown in FIG. 7A, each holder 71*h* and the wiper 71 held, by the holder 71*h* are movable upward and downward relatively to their case 78, by driving a corresponding solenoid 75. This movement allows each wiper 71 to take: a housed position where the wiper 71 is housed in its case 78 (see the wiper unit 70 positioned in the standby space V3 in FIG. 6B); and an exposed position where an upper end portion of the wiper 71, which portion contacts the corresponding ejection surface 10*a*, appears from the case 78 to be exposed (see the wiper unit 70 positioned in the opposed space V1 in FIG. 6B, and see FIG. 7A).

Each case 78 is a rectangular parallelepiped, box, and an opening 78*x* is formed through its top wall 78*t*. A thin-film cover 79 which covers the opening 78*x* is attached to a top surface of the top wall 78*t*. The cover 79 has a through hole 79*x* in a form of a slit. The through hole 79*x* has a width larger than a thickness of the corresponding wiper 71, and has a length longer than the length of the wiper 71 with respect to the sub scanning direction (see FIGS. 7A to 7C). At the time of the wiping, the upper end portion of the wiper 71 passes through the through hole 79*x*, and appears from the case 78. Both of the case 78 and the cover 79 are made of a lightproof material.

Inside each case 78, there are provided, a pair of plates 77 which sandwich the corresponding holder 71*h* from both sides in the main scanning direction. The holder 71*h* is moved upward and downward while being guided by the pair of plates 77. A spring 71S is disposed between the pair of plates 77, and between the holder 71*h* and the ease 78. The spring 71S urges the holder 71*h* upward.

Slits 77*s* and 78*s* are formed in one of the pair of plates 77 and a side wall of the case 78, respectively. A rod 71*p* protruding from a side surface of the holder 71*h* in the main scanning direction is inserted through these slits 77*s* and 78*s*, and is connected to a drive shaft of the corresponding solenoid 75. Therefore, as the drive shaft of the solenoid 75 extends and contracts, the rod 71*p* is moved upward and downward within the slits 77*s* and 78*s*, and the holder 71*h* and the wiper 71 are moved upward and downward.

Each sponge 70S is provided in the vicinity of a bottom of the corresponding case 78 in a space within the case 78, except a space between the pair of plates 77.

Figure 6C:
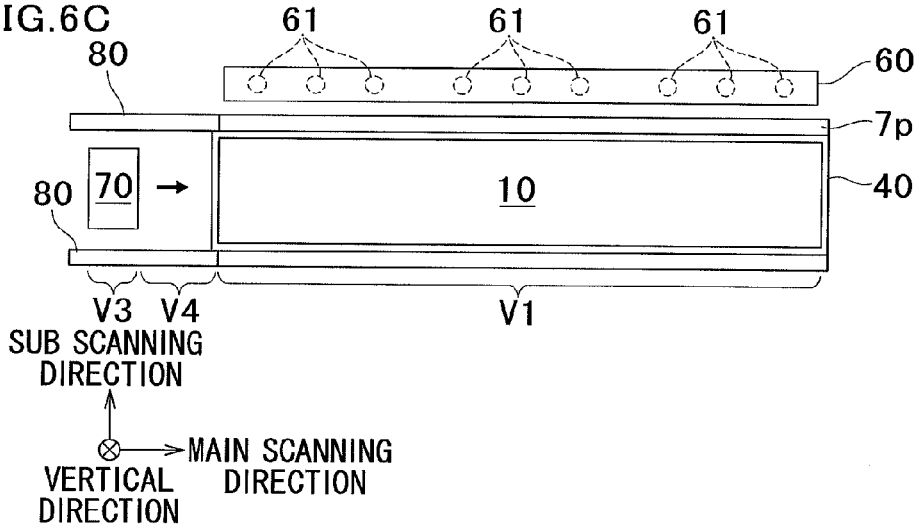
FIG. 6C is a plan view, viewed from a direction of VIC of FIG. 6A.

As shown in FIGS. 6B and 6C, each shading plate 80 is constituted by: a downstream plate 80 located downstream in the conveyance direction, which is an upper plate in a sheet of FIG. 6C; and an upstream plate 80 located upstream in the conveyance direction, which is a lower plate in the sheet of FIG. 6C. The upstream and downstream plates 80 are disposed so that they are opposed to each other and sandwich the corresponding standby space V3 in the sub scanning direction. Each of these plates 80 is a quadrangular plate made of a lightproof material, and is fixed to the housing 1*a* so that it extends in the vertical direction and the main scanning direction. Each of these plates 80 extends from the standby space V3 to a position above the passage unit 12 with respect to the vertical direction. The downstream plate 80 is disposed between the standby space V3 and the corresponding UV irradiator 60 with respect to the sub scanning direction, so as to cover the standby space V3 and the intermediate space V4. The downstream plate 80 is disposed at a position substantially same as that of the corresponding shaft 7*x*, with respect to the sub scanning direction. The upstream plate 80 is disposed at a position substantially same as that of a side wall of the corresponding cap 40 with respect to the sub scanning direction, which side wall is located upstream in the conveyance direction.

When the corresponding platen 7 is in the non-opposed position depicted with the alternate long and two short dashes lines in FIG. 6A, an end portion of its L-shaped portion 7*p* is in an upright posture. At this time, the downstream plate 80 is continuous with the upright end portion of the L-shaped portion 7*p*. Under this circumstance, the standby space V3 and the intermediate space V4 are shaded by the downstream plate 80, and the opposed space V1 is shaded by the platen 7, from ultraviolet light applied by the UV irradiator 60 positioned downstream of the corresponding head 10 in the conveyance direction. Further, under this circumstance, the standby space V3 and the intermediate space V4 are shaded by the upstream plate 80, and the opposed space V1 is shaded by the cap 40, from ultraviolet light applied by the UV irradiator 60 positioned upstream of the corresponding head 10 in the conveyance direction.

Figure 8:
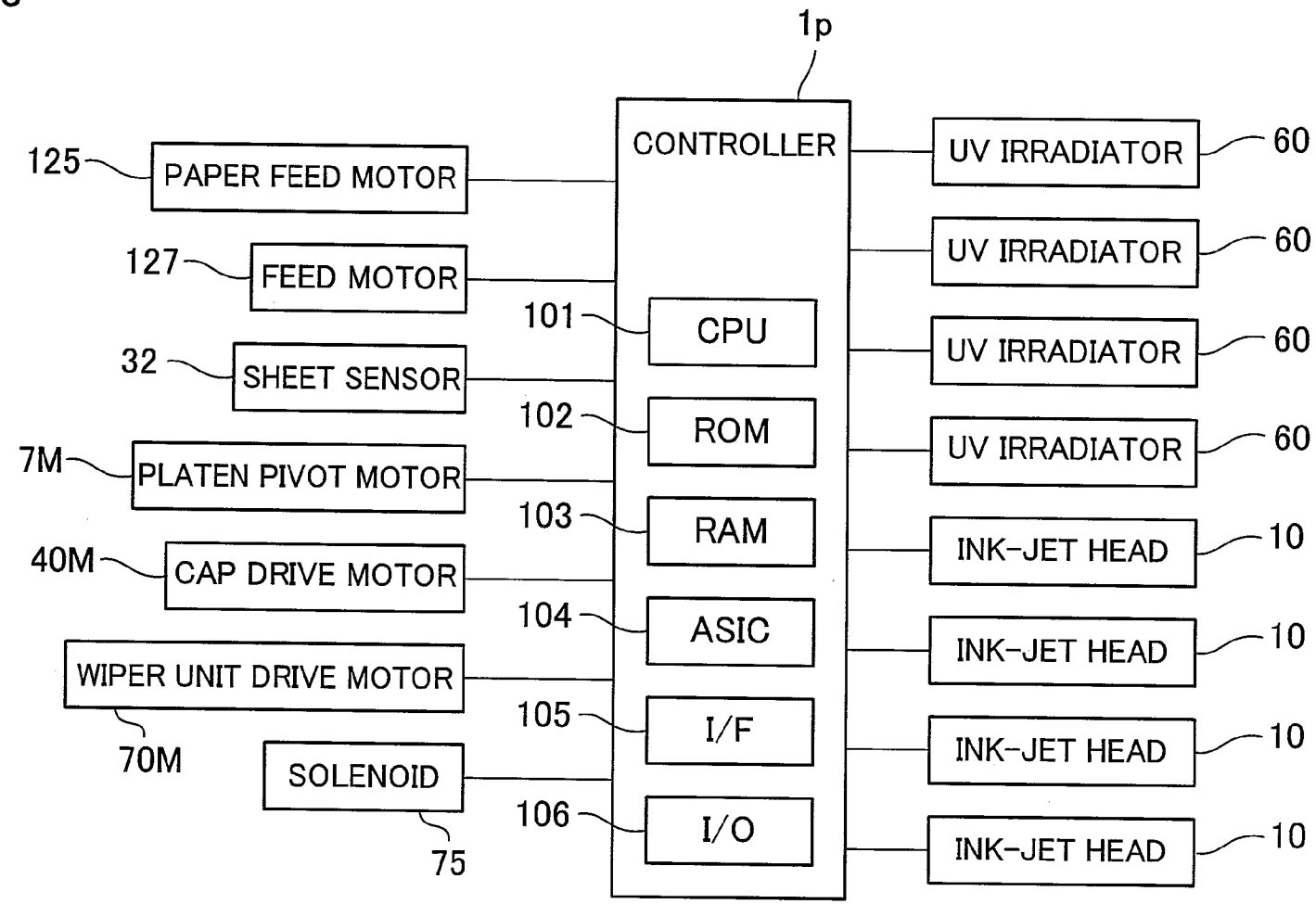
FIG. 8 is a block diagram illustrating an electrical structure of the printer.

The following describes an electrical structure of the printer 1, with reference to FIG. 8.

As shown in FIG. 8, the controller 1*p* has, in addition to a CPU (Central Processing Unit) 101, a ROM (Read Only Memory) 102, a RAM (Random Access Memory, including a non-volatile RAM) 103, an ASIC (Application Specific Integrated Circuit) 104, an I/F (Interface) 105, an I/O (Input/Output Port) 106, and the like. The ROM 102 stores therein: programs executed by the CPU 101; various fixed, data; and the like. The RAM 103 temporarily stores therein data needed at the time of execution of a program. In the ASIC 104, rewriting, sorting, or the like of image data, such as signal processing or image processing is conducted. The I/F 105 transmits/receives data to/from the external device. The I/O 106 inputs/outputs detection signals of various sensors.

The controller 1*p* is connected to: each of the motors 125 and 127; the sheet sensor 32; the control substrates of the heads 10; the UV irradiators 60, and the like. Further, the controller 1*p* is connected to: platen pivot motors 7M which pivot the respective platens 7; cap drive motors 40M which drive the respective gears 40G (see FIG. 6B); wiper unit drive motors TOM which move the respective wiper units 70 together with their cases 78 in the main scanning direction or the vertical direction; and the solenoids 75. Note that, the motors 7M, 40M, and TOM and the solenoids 75 are provided for the respective heads 10; however, FIG. 8 illustrates only the motors and the solenoid corresponding to one head 10, for the sake of simplification.

Figure 9:
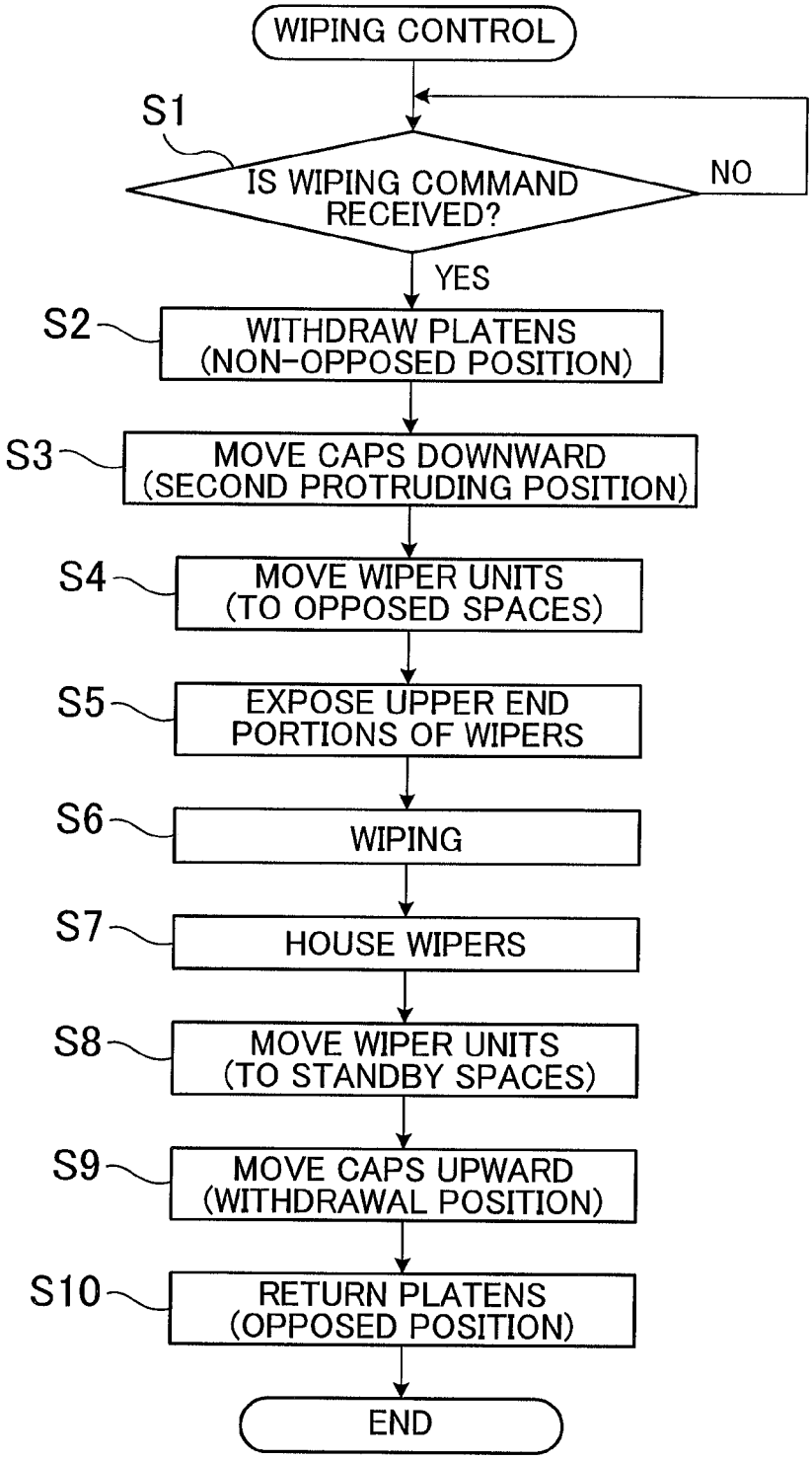
FIG. 9 is a flow diagram illustrating control processing of a wiping operation executed by a controller of the printer.

The following describes control processing of a wiping operation executed by the controller 1*p*, with reference to FIG. 9. The following steps are executed by the CPU 101 in accordance with the programs stored in the ROM 102.

As shown in FIG. 9, the controller 1*p* first determines whether or not a wiping command is received (S1). The wiping command is received, for example, after the preliminary ejection, i.e., after the preliminary ejection is performed immediately after the printer 1 is powered on, as described above. Note that, before the wiping command, is received, each platen 7 is in the opposed position, each cap 40 is in the withdrawal position, each wiper unit 70 is in the standby space V3, and each wiper 71 is in the housed position.

On receiving the wiping command (S1: YES), the controller 1*p* drives each platen pivot motor 7M, to withdraw the corresponding platen 7, that is, to move the corresponding platen 7 from the opposed position to the non-opposed position (S2). At this time, the end portion of the L-shaped portion 7*p* of each platen 7 is in the upright posture, and the inner wall surface of the L-shaped portion 7*p* is opposed to the side wail of the corresponding cap 40, which side wall located downstream in the conveyance direction, and is opposed to the lower end 40*a* of the cap 40. On the other hand, the flat portion of each platen 7 is hanged, downward. As a result, each platen 7 shades the corresponding opposed space V1 from ultraviolet light applied by the UV irradiator 60 located downstream of the corresponding head 10 in the conveyance direction.

After the S2, the controller 1*p* drives each cap drive motor 40M, to move the corresponding cap 40 downward from the withdrawal position to the second, protruding position (S3). At this time, as shown in FIG. 6A, a part of the lower end 40*a* of the cap 40, which part is located downstream of the corresponding to head 10 in the conveyance direction, contacts the inner wall surface of the L-shaped portion 7*p* of the corresponding platen 7, that is, a surface of the shading sheet 7*b*. This ensures that each opposed space V1 is shaded from ultraviolet light applied by the UV irradiator 60 located downstream of the corresponding head 10 in the conveyance direction.

After the S3, the controller 1*p* drives each wiper unit drive motor 70M, to move the corresponding wiper unit 70 together with its case 78, from the standby space V3, via the intermediate space V4, to the opposed, space V1, along the main scanning direction (S4). Note that, in the standby space V3, the wiper unit 70 is positioned below the lower end 40*a* of the corresponding cap 40 which is in the second protruding position. Therefore, when the wiper unit 70 is moved below the cap 40 in the S4, no collision occurs between the wiper unit 70 and the cap 40. The controller 1*p* stops the movement of each wiper unit 70 along the main scanning direction when the wiper unit 70 reaches an end of the corresponding opposed space V1, which end is farther from the standby space V3 with respect to the main scanning direction, i.e., a right end of the opposed space V1 in FIG. 6B. Then the controller 1*p* drives each wiper unit drive motor 40M, to move the corresponding wiper unit 70 together with its case 78 slightly upward to a position where an upper end of the case 78 is leveled with the lower end 40*a* of the corresponding cap 40. This blocks ultraviolet light applied from the UV irradiator 60 located downstream of the corresponding head 10 in the conveyance direction from reaching the wiper 71 which will appear from the case 78 in a subsequent step of S5.

After the S4, the controller 1*p* drives each solenoid 75, to move the corresponding wiper 71 from the housed position to the exposed position (S5). Note that, at this moment, the wiper 71 has not contacted the corresponding ejection surface 10*a* yet.

After the S5, the controller 1*p* drives each wiper unit drive motor 70M, to move the corresponding wiper unit 70 together with its case 78 slightly upward to a position where each wiper 71 contacts the corresponding ejection surface 10*a* while being warped. Further, the controller 1*p* drives each wiper unit drive motor 70M, to move the corresponding wiper unit 70 together with its case 78 toward its standby space V3 within its opposed space V1 along the main scanning direction, and thereby performs the wiping (S6). Ultraviolet light does not reach an area where each wiper 71 is moved during this operation. At this time, the upper end portion of each wiper 71 is moved relatively to the corresponding ejection surface 10*a*, while contacting the ejection surface 10*a*. As a result, foreign matter attached to the ejection surface 10*a* is wiped out. The controller 1*p* stops the movement of each wiper unit 70 along the main scanning direction when the wiper unit 70 reaches an other end of the corresponding opposed space V1, which end is closer to the standby space V3 with respect to the main scanning direction, i.e., a left end of the opposed, space V1 in FIG. 6B. Then, the controller 1*p* moves each wiper unit 70 slightly downward to a position where each wiper 71 is separated from the corresponding ejection surface 10*a*.

Note that, depending on a manner of the downward movement, there is a possibility that, when the wiper 71 is separated from the ejection surface 10*a*, elasticity of the wiper 71 rapidly returns the wiper 71 into a state where the wiper 71 has not yet contacted, the ejection surface 10*a*, with the result that ink attached to the wiper 71 is spattered in the housing 1*a*. Therefore, the sponge 40S is provided inside each cap 40 in this embodiment. This allows the ink attached to each wiper 71 to be absorbed by the sponge 40S, and minimizes problems such as above-described spattering of ink.

Before and after the wiping of the S6, that is, when each wiper 71 is in the exposed position and does not contact the corresponding ejection surface 10*a*, each wiper 71 is at a substantially central position in the corresponding through hole 79*x* (see FIG. 7B (b1), and FIG. 7C (c1)). At this time, a width x1 of a gap between: a wipe surface 71*w*1 of the wiper 71, which surface is located downstream in a movement direction where the wiper 71 moves: and a portion of the corresponding cover 79 which defines the through hole 79*x* and is opposed to the wipe surface 71*w*1 in the main scanning direction, is substantially equal to a width x2 of a gap between: a back surface 71*w*2 of the wiper 71, which surface is located upstream in the movement direction; and a portion of the cover 79 which defines the through hole 79*x* and is opposed to the back surface 71*w*2 in the main scanning direction.

During the wiping of the S6, the wiper 71 contacts the ejection surface 10*a* and is warped, and the back surface 71*w*2 contacts the cover 79. At this time, the width x2 is approximately equal to zero, while the width x1 is larger than the width x1 observed before and after the wiping (see FIG. 7B (b2) and FIG. 7C (c2)). That is, since the width x1 is larger during the wiping, foreign matter wiped by the wiper 71 is surely collected into its case 78, and this decreases a possibility that the foreign matter is spattered outside the case 78. Meanwhile, after the wiping, the width x1 becomes smaller than that during the wiping, and this decrease a possibility that foreign matter, such as ink in particular, attached to the wipe surface 71*w*1 is exposed to ultraviolet light. Note that, from this viewpoint, an arrangement may be adopted in which the width x1 becomes approximately equal to zero after the wiping. This arrangement further decreases the possibility that foreign matter, such as ink in particular, attached to the wipe surface 71*w*1 is exposed to ultraviolet light.

After the S6, the controller 1*p* drives each solenoid 75, to move the corresponding wiper 71 from the exposed position to the housed position (S7).

After the S7, the controller 1*p* drives each wiper unit drive motor 70M, to move the corresponding wiper unit 70 together with its case 78 downward to a position where the case 78 does not overlap the corresponding cap 40 with respect to the vertical direction. The controller 1*p* further drives each wiper unit drive motor 70M, to move the corresponding wiper unit 70 together with its case 78, from the opposed space V1 via the intermediate space V4 to the standby space V3, along the main scanning direction (S8). The controller 1*p* stops the movement of each wiper unit 70 along the main scanning direction when each wiper unit 70 reaches the standby space V3.

After the S8, the controller 1*p* drives each cap drive motor 40M to move the corresponding cap 40 upward, from the second, protruding position to the withdrawal position (S9).

After the S9, the controller 1*p* drives each platen pivot motor 7M, to return the corresponding platen 7, that is, to move the corresponding platen 7 from the non-opposed position to the opposed position (S10). With this, the wiping operation is completed.

As described above, according to the printer 1 and the controller 1*p* of this embodiment, each opposed space V1 is shaded by the corresponding cap 40 which is in the second protruding position from ultraviolet light applied, by the UV irradiators 60, as shown in FIG. 6B. When the wiping is performed, each wiper 71 is positioned in the opposed, space V1 and each cap 40 is positioned in the second protruding position. This prevents ink attached to each wiper 71 from being cured, without turning off the UV irradiators 60 during the wiping.

The caps 40 are used not only for shading but also for capping (see FIG. 6A). This leads to a simplification of the structure of the apparatus.

The platens 7 are used for the capping. This eliminates the necessity to provide another member for the capping, leading to a simplification of the structure of the apparatus. In addition, this realizes a speedy shift from the recording operation to the capping.

Each platen 7 is pivotable. This realizes: an easy shift from the opposed position to the non-opposed position; and an easy shift from the non-opposed position to the opposed position. Further, this leads to space conservation.

There are provided the shading sheets 7*b*, each of which is interposed between the corresponding cap 40 and platen 7 when the cap 40 is positioned in the second protruding position and the platen 7 is positioned in the non-opposed position. The shading sheet 7*b* prevents ultraviolet light applied, by the corresponding UV irradiator 60 from entering into the corresponding opposed, space V1 through a gap between the cap 40 and the platen 7, and this further ensures that curing of ink attached to the corresponding wiper 71 is prevented.

Since the wiping is performed, in each opposed space V1, there may be a case where the wiper 71 contacts the inner surface of the corresponding cap 40, which surface defines the opposed space V1, or a case where ink having been wiped out during the wiping is spattered to be attached to the inner surface. Such cases provide a possibility that the ink attached to the surface drops and is attached to the platen 7, a sheet P, or another member inside the housing 1*a*. The sponge 40S is provided on the inner surface of each cap 40 in this embodiment, and therefore occurrence of the above-described problem is decreased.

Each wiper 71 is shaded from ultraviolet light applied by the UV irradiators 60, by the corresponding cap 40 during the wiping, and by its wiper case 78 and the corresponding shading plate 80 when the wiper 71 is positioned in the standby space V3 or in the intermediate space V4. That is, each wiper 71 is always shaded from ultraviolet light applied, by the UV irradiators 60, not only during the wiping. Accordingly, it is possible to prevent ink attached to the wipers 71 from being cured, without switching the UV irradiators 60 between on and off.

Moreover, the wipers 71 are shaded from ultraviolet light using a relatively simple structure, i.e., by the wiper cases 78 and the shading plates 80.

Each wiper case 78 has the cover 79, and each wiper 71 passes through the through hole 79*x* of the corresponding cover 79 to be exposed. As shown in FIG. 7B (b2) and FIG. 7C (c2), during the wiping, the gap indicated by the width x1 is reserved between the wipe surface 71*w*1 and the portion of the cover 79 which defines the through hole 79*x* and is opposed to the wipe surface 71*w*1 in the main scanning direction. As shown in FIG. 7B (b1) and FIG. 7C (c1), the width x1 of the gap becomes smaller when the wiping is completed and the wiper 71 is separated from the ejection surface 10*a*, compared to the width x1 during the wiping. That is, the width x1 shown in FIG. 7C (c1) is smaller than the width x1 shown in FIG. 7C (c2). If ink having been wiped, out during the wiping is spattered outside the wiper cases 78 and is attached to another member in the housing 1*a*, not only a smear problem but also other problems may occur because the ink is cured. In the above-described structure of this embodiment, ink having been wiped out during the wiping is introduced into the wiper cases 78 from the respective gaps shown in FIG. 7B (b2) indicated by the width x1. Therefore, occurrence of the above-described problems is decreased. Further, since the width x1 of each gap becomes smaller as shown in FIG. 7B (b1) after the wiping is completed, it is possible to effectively prevent the ink attached to each wipe surface 71*w*1 from being cured.

Since the sponge 70S is provided in each wiper case 78, ink which has been wiped out during the wiping and has entered into each wiper case 78 is retained, by the sponge 70S.

Figure 10:
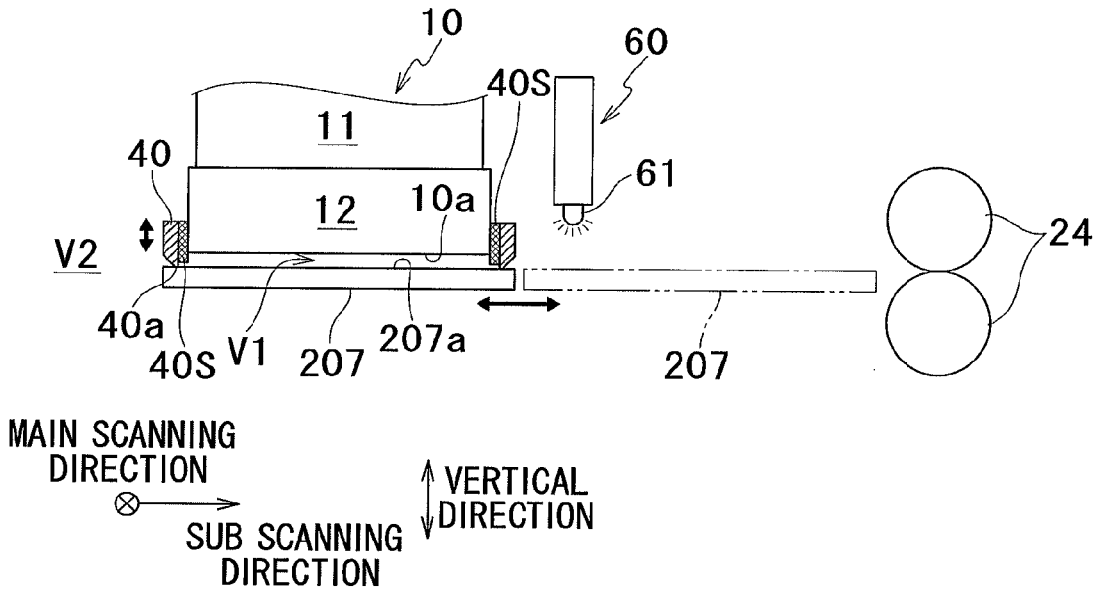
FIG. 10 is a partial sectional side view, corresponding to FIG. 6A, of an ink-jet printer which is a second embodiment of the recording apparatus of the present invention.

The following describes an ink-jet printer which is a second embodiment of the recording apparatus of the present invention, with reference to FIG. 10. The printer of the second, embodiment is different from that of the first embodiment in that platens are not pivotable but are movable in a horizontal direction, but other structures thereof are same as those of the first embodiment.

Each of platens 207 of this embodiment is movable in the sub scanning direction, and this movement allows each platen 207 to selectively take: an opposed position where the platen 207 is opposed to a corresponding ejection surface 10*a* in the vertical direction, as depicted with a solid line in FIG. 10; and a non-opposed position where the platen 207 is not opposed to the ejection surface 10*a*, as depicted with an alternate long and two short dashes line in FIG. 10. Controlled by a controller 1*p*, each platen 207 takes the non-opposed position at the time of the wiping, and takes the opposed position at times other than the wiping. During the capping, each cap 40 contacts a corresponding support surface 207*a*.

Figure 11:
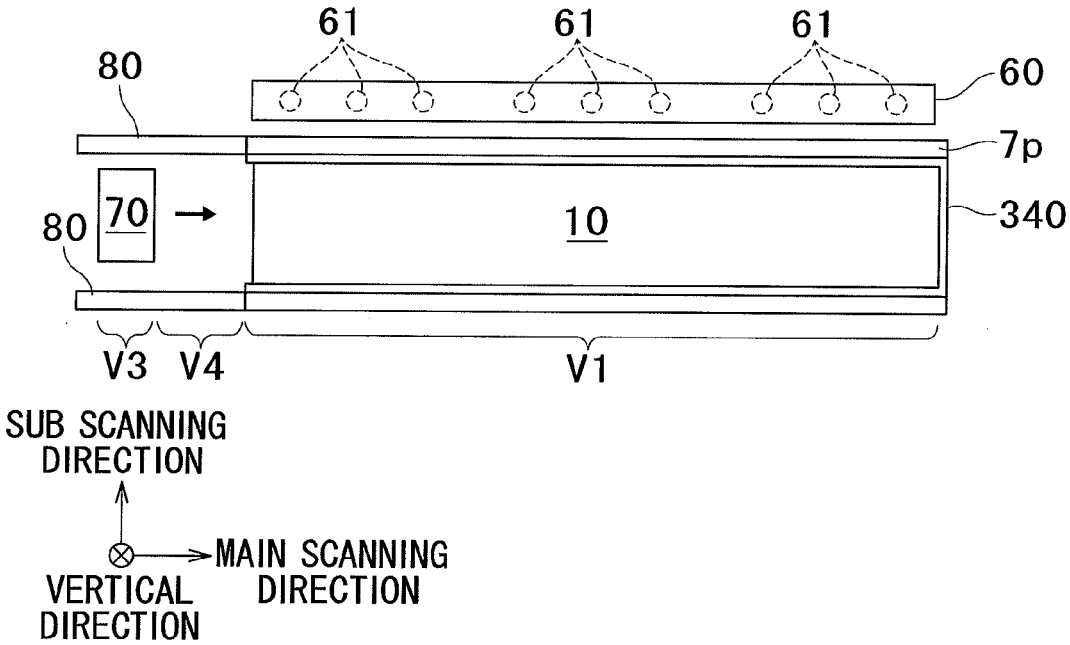
FIG. 11 is a plan view, corresponding to FIG. 6C, of an ink-jet printer which is a third embodiment of the recording apparatus of the present invention.

The following describes an ink-jet printer which is a third embodiment of the recording apparatus of the present invention, with reference to FIG. 11. The printer of the third embodiment is different from that of the first embodiment in the structure of caps, but other structures are same as those of the first embodiment.

Each of caps 340 of this embodiment corresponds to each cap 40 of the first embodiment, but does not have a side wall which is near a corresponding standby space V3. That is, each cap 340 has an approximate U-shape in a plan view. In this case, it is possible to limit the movement direction of each wiper unit 70 for the wiping, to the main scanning direction. That is, in the first embodiment, since the above-described side wall is provided, control operation is performed so as to avoid a collision between each cap 40 and the corresponding wiper unit 70. Specifically, as shown in FIG. 6B, each wiper unit 70 is first positioned, within the standby space V3, below the lower end 40*a* of the corresponding cap 40 which is in the second protruding position, and the wiper unit 70 is then moved upward after the wiper unit 70 reaches the opposed space V1. On the other hand, in this embodiment, since the above-described side wall is not provided, a collision between each cap 340 and a corresponding wiper unit 70 is avoided even if the following control operation is performed. That is, the following control operation is possible: each wiper unit 70 is first positioned above a lower end of the corresponding cap 340 in the standby space V3; then the wiper unit 70 is moved in the main scanning direction; and the wiping is started without moving the wiper unit 70 upward.

Note that, in addition to the caps 340, it is preferable to provide other caps so that the respective opposed spaces V1 are entirely covered by them in cooperation with the corresponding caps 340 and thereby the opposed spaces V1 are separated from the external space. This realizes preferable capping.

Figure 12:
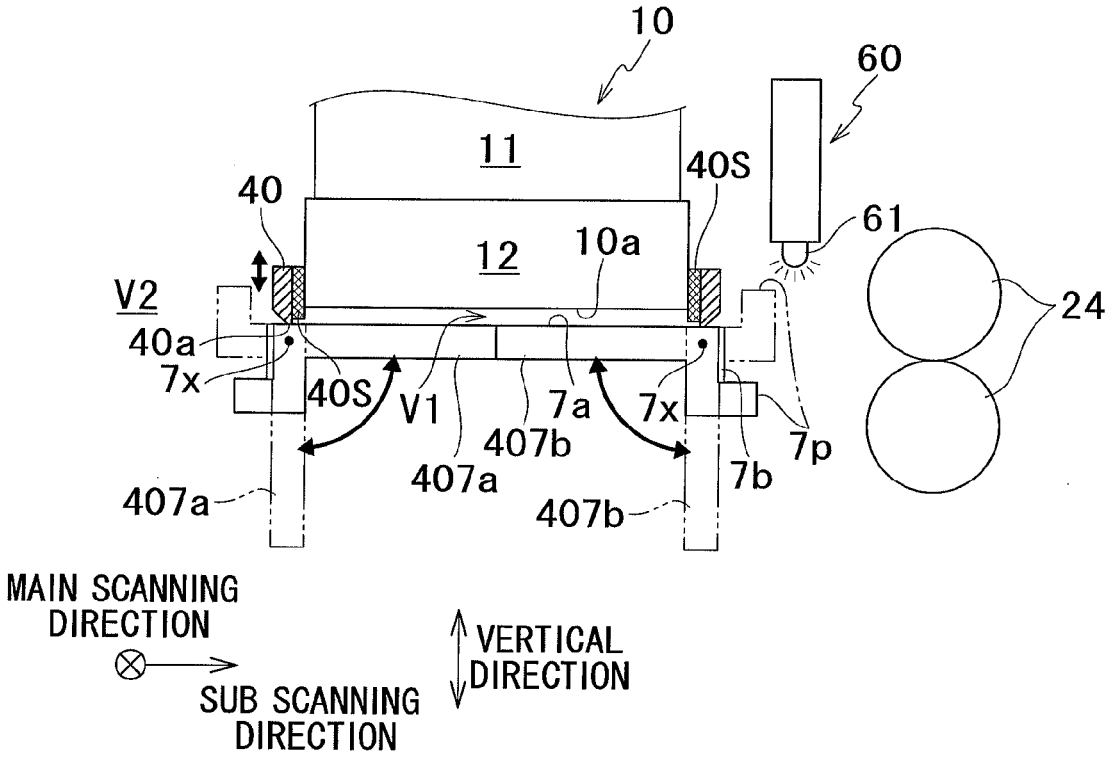
FIG. 12 is a partial sectional side view, corresponding to FIG. 6A, of an ink-jet printer which is a fourth embodiment of the recording apparatus of the present invention.

The following describes an ink-jet printer which is a fourth embodiment of the recording apparatus of the present invention, with reference to FIG. 12. The printer of the fourth embodiment is different from that of the first embodiment in the structure of platens, but other structures are same as those of the first embodiment.

Each of the platens of this embodiment is constituted by: a partial platen 407*a* located upstream in the conveyance direction; and a partial platen 407*b* located, downstream in the conveyance direction. Each of the partial platens 407*a* and 407*b* has a flat portion and an L-shaped portion 7*p*, and has a pivot axis 7*x* extending in the main scanning direction at a connection between the flat portion and the L-shaped portion 7*p*. Pivoting movement about the pivot axis 7*x* allows each partial platen 407*a*, 407*b* to selectively take: an opposed position where its flat portion is held, horizontally with respect to the vertical direction and opposed to a corresponding ejection surface 10*a* in the vertical direction, as depicted with solid lines in FIG. 12; and a non-opposed position where its flat portion is not opposed to the ejection surface 10*a* but is hanged downward, as depicted with alternate long and two short dashes lines in FIG. 12. In the same way as the platens 7 of the first embodiment, each of the partial platens 407*a* and 407*b* takes the non-opposed, position at the time of the wiping, and takes the opposed position at times other than the wiping.

The partial platens 407*a* and 407*b* are symmetrical with respect to a vertical line passing through a center, in the sub scanning direction, of a corresponding head 10, when viewed from the main scanning direction. In the partial platen 407*a*, its pivot axis 7*x* is located, at an end of its flat portion, which end is located upstream in the conveyance direction. In the partial platen 407*b*, its pivot axis 7*x* is located, an end of its flat portion, which end is located downstream in the conveyance direction. As depicted with the solid lines in FIG. 12, when both of the partial platens 407*a* and 407*b* are in the opposed position, the flat portions of the both partial platens 407*a* and 407*b* form one platen surface, with their respective ends, which are respectively opposite from their ends having the pivot axes 7*x*, contacting each other while being opposed to each other in the sub scanning direction.

The structure of the platens of this embodiment is preferably employed particularly in the case where each cap 40 acting as the first shading member is in the same position during the wiping and during the capping.

In each of the second, third, and fourth embodiments, the structures same as those of the first embodiment bring about advantageous effects same as those of the first embodiment.

The conveyor does not have to be constituted of the platens and the pairs of feed rollers, but may be constituted, of a pair of rollers positioned apart from each other and an endless conveyor belt looped around, the rollers, for example.

The first shading member may be in the same position during the wiping and during the capping. To be more specific, in the first embodiment, the position of each cap 40 acting as the first shading member during the wiping is different from the position during the capping. That is, the position during the capping is the first protruding position, while the position during the wiping is the second protruding position. However, the position during the wiping and the position during the capping may be the same, for example, the first protruding position.

The first shading member does not limited, to the annular caps 40 or the caps 340 each having the approximate U-shape in a plan view, but may be plates like the shading plates 80. For example, the first shading member may be plates provided to sides of each head 10, which sides are opposed to the UV irradiators 60. In this case, the plates may be disposed so that the plates sandwich each head 10 from both sides in the conveyance direction.

The first shading member does not have to be used for the capping. Further, a medium support member such as a platen does not have to be used for the capping.

The timing at which the first shading member is positioned in the protruding position may be before or after the wiper is positioned in the opposed space. To be more specific, in the first embodiment, after each cap 40 is positioned in the protruding position, each wiper 71 is positioned in the corresponding opposed space V1. That is, the timing at which the first shading member is positioned in the protruding position is before the wiper is positioned in the opposed space. However, the present invention is not limited thereto, and for example, each cap 40 may be positioned in the protruding position after each wiper 71 is positioned in the opposed space V1. That is, the timing at which the first shading member is positioned in the protruding position may be after the wiper is positioned in the opposed space.

The shading sheets 7*b*, the sponges 40S, or the like may be omitted, if appropriate.

The wiper may be non-movable relatively to the wiper case. The holding member such as the sponges 70S does not have to be provided in the wiper case. The cover of the wiper case may be attached so that the cover is slightly movable relatively to the wiper case in a movement direction where the wiper moves relative to the ejection surface. In this case, the wiper warped during the wiping moves the cover slightly since the cover is pushed by the back surface of the wiper, which is the opposite surface of the wiper from the wipe surface, and as a result, a gap is reserved between the wipe surface and a portion of the cover which defines the through hole and is opposed to the wipe surface in the movement direction. Then, when the wiping is completed and the wiper is separated from the ejection surface and is returned from a warped state, a size of the gap in the movement direction may become smaller than that during the wiping.

Both of the wiper eases 78 and the shading plates 80 are used as the shading unit in the first embodiment; however, either of them may be used as the shading unit. For example, the wiper eases 78 may be omitted, and only the shading plates 80 may be used for shading the wipers 71 from ultraviolet light applied by the UV irradiators 60, with respect to spaces from the standby spaces V3 to the opposed spaces V1. Alternatively, the shading plates 80 may be omitted, and only the wiper cases 78 may be used for shading the wipers 71 from ultraviolet light applied by the UV irradiators 60, with respect to spaces from the standby spaces V3 to the opposed spaces V1.

The recording apparatus may include an arbitrary number of heads. When the recording apparatus includes a plurality of heads, the UV irradiator does not have to be provided downstream of each of the heads in the conveyance direction, as long as the UV irradiator is provided downstream of at least one of the heads in the conveyance direction. Further, the first shading member does not have to be provided for every head, as long as it is provided for at least one of the heads. To be more specific, in the first embodiment, the UV irradiators 60 are respectively provided, for the four heads 10; however, another arrangement is also possible, for example, only one UV irradiator 60 may be provided downstream, in the conveyance direction, of a most downstream head 10 in the conveyance direction, i.e., the rightmost head 10 in FIG. 1.

The head may eject any liquid other than ink as long as the liquid is curable by irradiation of ultraviolet light. For example, the head, is not limited to a recording head which ejects recording liquid directly contributing to image formation, but may be a head which ejects treatment liquid having a function of preventing bleed of the recording liquid on a recording-medium, or the like.

The platen is constituted by one member in the first embodiment, and is constituted by two members in the fourth embodiment; however, the platen may be constituted by three or more members, and various other alterations thereto are possible.

The present invention is applicable to both of a line-type apparatus and a serial-type apparatus. In addition, the present invention is applicable not only to a printer, but also to another recording apparatus such as a facsimile machine, a copy machine, or the like.

The recording medium is not limited to a sheet, but may be various media on which recording is possible.

The present invention brings about an advantageous effect that it is possible to prevent liquid attached to the wiper from being cured without turning off the UV irradiator during the wiping. However, the UV irradiator may be turned, off during the wiping, or the UV irradiator may be switched between on and off.

While this invention has been described in conjunction with the specific embodiments outlined above, it is evident that many alternatives, modifications and variations will be apparent to those skilled in the art. Accordingly, the preferred, embodiments of the invention as set forth above are intended to be illustrative, not limiting. Various changes may be made without departing from the spirit and scope of the invention as defined in the following claims.

What is claimed is:

1. A recording apparatus comprising:

a conveyor which conveys a recording medium in a conveyance direction;

a head including an ejection surface at which a plurality of ejection openings are formed from which openings liquid curable by irradiation of ultraviolet light is ejected to the recording medium;

an opposed member including an opposed surface which is opposed to the ejection surface;

a UV irradiator which is positioned downstream of the head in the conveyance direction and applies ultraviolet light to the recording medium;

a wiper which is movable relatively to the ejection surface while contacting the ejection surface and performs wiping in which foreign matter attached to the ejection surface is wiped out;

a first shading member which is movable in a cross direction crossing the ejection surface, and shades an opposed space, which is opposed to the ejection surface, from ultraviolet light applied by the UV irradiator in a state where the first shading member is taking a protruding position, the first shading member in the protruding position disposed around the ejection surface without being opposed to the ejection surface and between the ejection surface and the UV irradiator and protruding from the ejection surface toward the opposed space in the cross direction;

a second shading member which is interposed between the first shading member and the opposed member when the first shading member is in the protruding position and the opposed member is in a non-opposed position where the opposed member is not opposed to the ejection surface in an orthogonal direction orthogonal to the ejection surface;

a first controller which controls the first shading member to take the protruding position; and a second controller which controls the wiper to move relatively to the ejection surface while causing the wiper to contact the ejection surface in a state where the wiper is positioned in the opposed space and the first shading member is taking the protruding position, when the wiping is performed.

2. The recording apparatus according to claim 1, further comprising a third controller which controls the first shading member to move in the cross direction, and causes a protruding end of the first shading member to contact the opposed surface, thereby to separate the opposed space between the ejection surface and the opposed surface from an external space.

3. The recording apparatus according to claim 1, wherein the opposed surface supports the recording medium.

4. The recording apparatus according to claim 1, wherein the opposed member is pivotable about an axis parallel to the ejection surface and orthogonal to the conveyance direction, and the opposed member selectively takes an opposed position, where the opposed member is opposed to the ejection surface in the orthogonal direction, and the non-opposed position.

5. The recording apparatus according to claim 1, wherein a holding member capable of retaining the liquid is provided on a surface of the first shading member, which surface defines the opposed space.

6. The recording apparatus according to claim 1, further comprising a shading unit which shades the wiper from ultraviolet light applied by the UV irradiator when the wiper is positioned in a standby space which is outside the opposed space and when the wiper is positioned in an intermediate space which is between the standby space and the opposed space.

7. The recording apparatus according to claim 6, wherein the shading unit includes at least one of: a wiper case which houses the wiper; and a shading plate which is positioned between the standby space and the UV irradiator with respect to the conveyance direction and covers the standby space and the intermediate space.

8. The recording apparatus according to claim 7, wherein the shading unit includes:

the wiper case movable from the standby space to the opposed space and from the opposed space to the standby space;

a movement mechanism which moves the wiper relatively to the wiper case; and a fourth controller which controls the movement mechanism to cause the wiper to be housed in the wiper case when the wiper is positioned in the standby space and when the wiper is positioned in the intermediate space, and to cause at least a portion of the wiper, which portion contacts the ejection surface, to appear from the wiper case when the wiper is positioned in the opposed space.

9. The recording apparatus according to claim 7, wherein:

the wiper case includes an opening, and a cover which covers the opening and includes a through hole formed in the cover;

when the wiping is performed, at least a portion of the wiper which portion contacts the ejection surface appears from the wiper case through the through hole;

during the wiping, a gap is reserved between a wipe surface of the wiper, which surface is located downstream in a movement direction where the wiper moves relative to the ejection surface, and a portion of the cover, which portion defines the through hole and is opposed to the wipe surface in the movement direction; and when the wiping is completed and the wiper is separated from the ejection surface, a size of the gap in the movement direction becomes smaller than the size during the wiping.

10. The recording apparatus according to claim 7, wherein a holding member capable of retaining the liquid is provided in the wiper case.

11. A controller which is used in a recording apparatus, the recording apparatus including: a conveyor which conveys a recording medium in a conveyance direction; a head including an ejection surface at which a plurality of ejection openings are formed from which openings liquid curable by irradiation of ultraviolet light is ejected to the recording medium; an opposed member including an opposed surface which is opposed to the ejection surface; a UV irradiator which is positioned downstream of the head in the conveyance direction and applies ultraviolet light to the recording medium; a wiper which is movable relatively to the ejection surface while contacting the ejection surface and performs wiping in which foreign matter attached to the ejection surface is wiped out; a first shading member which is movable in a cross direction crossing the ejection surface, and shades an opposed space, which is opposed to the ejection surface from ultraviolet light applied by the UV irradiator in a state where the first shading member is taking a protruding position, the first shading member in the protruding position disposed around the ejection surface without being opposed to the ejection surface and between the ejection surface and the UV irradiator and protruding from the ejection surface toward the opposed space in the cross direction; and a second shading member which is interposed between the first shading member and the opposed member when the first shading member is in the protruding position and the opposed member is in a non-opposed position where the opposed member is not opposed to the ejection surface in an orthogonal direction orthogonal to the ejection surface, the controller comprising:

a first controller which controls the first shading member to take the protruding position; and a second controller which controls the wiper to move relatively to the ejection surface while causing the wiper to contact the ejection surface in a state where the wiper is positioned in the opposed space and the first shading member is taking the protruding position, when the wiping is performed.

12. The recording apparatus according to claim 1, wherein the first shading member is disposed around the ejection surface so as to be enclosed.

13. The controller according to claim 11, wherein the first shading member is disposed around the ejection surface so as to be enclosed.

* * * * *